US011313120B2

(12) United States Patent
Bibi

(10) Patent No.: US 11,313,120 B2
(45) Date of Patent: Apr. 26, 2022

(54) METHOD AND SYSTEM FOR PROVIDING PREPARING AND ASSEMBLING A HIGH END PREFABRICATED PRODUCT TO SERVE AS A WINDOW COVERING OR ROOM DIVIDER

(71) Applicant: Joseph Bibi, Brooklyn, NY (US)

(72) Inventor: Joseph Bibi, Brooklyn, NY (US)

( * ) Notice: Subject to any disclaimer, the term of this patent is extended or adjusted under 35 U.S.C. 154(b) by 444 days.

(21) Appl. No.: 16/166,109

(22) Filed: Oct. 21, 2018

(65) Prior Publication Data

US 2020/0123767 A1 Apr. 23, 2020

(51) Int. Cl.

| | |
|---|---|
| ***A47H 23/14*** | (2006.01) |
| ***E04B 2/82*** | (2006.01) |
| ***E04B 2/74*** | (2006.01) |
| ***E04B 2/80*** | (2006.01) |
| *A47H 1/02* | (2006.01) |
| *A47H 23/01* | (2006.01) |

(52) U.S. Cl.

CPC ..... *E04B 2/821* (2013.01); *E04B 2/7401* (2013.01); *E04B 2/80* (2013.01); *A47H 1/02* (2013.01); *A47H 23/01* (2013.01); *A47H 23/14* (2013.01)

(58) Field of Classification Search

CPC ..... A47H 23/01; A47H 23/00; A47H 23/14; A47H 23/02; A47H 23/08; A47H 2023/025; E04B 2/7401; E04B 2/74; E04B 2/821; E04B 2/80; E04B 2/825; E04B 2/88; E04B 2002/7468

See application file for complete search history.

(56) References Cited

U.S. PATENT DOCUMENTS

| | | | | | |
|---|---|---|---|---|---|
| 52,577 | A | * | 2/1866 | Landis | A47H 13/00 160/330 |
| 203,468 | A | * | 5/1878 | Lane | A47H 23/01 160/393 |
| 214,926 | A | * | 4/1879 | Lane | A47H 23/01 160/349.1 |
| 444,230 | A | * | 1/1891 | Stauss | A47H 13/00 160/330 |
| 600,852 | A | * | 3/1898 | Baisley | A47H 23/01 160/393 |
| 661,494 | A | * | 11/1900 | Clark | A47H 13/00 160/330 |
| 720,354 | A | * | 2/1903 | Hunt | A47H 23/01 160/393 |
| 762,659 | A | * | 6/1904 | Schaffer | A47H 13/00 160/330 |
| 782,484 | A | * | 2/1905 | Campbell | A47H 13/00 160/330 |
| 785,858 | A | * | 3/1905 | Castner | A47H 13/00 160/330 |

(Continued)

*Primary Examiner* — Johnnie A. Shablack

(57) ABSTRACT

The present invention is a method of preparing and assembling certain prefabricated products (identified below as (a) Suspension Rods; (b) Decorative Finished Wood; (c) Locking Pin; and (d) Rubber Gasket) which, once assembled, will serve as a high end room divider or window covering (also known as window treatments). The inventive framework allows the user who is preparing and assembling the product to have an installed room divider or window coverage that is clean, with no marks, and also able to be assembled by one person, as opposed to having multiple parties present to effect installation.

7 Claims, 4 Drawing Sheets

(56) References Cited

U.S. PATENT DOCUMENTS 793,967 A * 7/1905 Upperman ..... A47H 13/00 160/330
1,061,988 A * 5/1913 Currie ..... A47H 13/00 160/330
1,068,498 A * 7/1913 Harding ..... A47H 13/00 160/330
1,269,508 A * 6/1918 Province ..... A47H 13/00 160/330
1,506,622 A * 8/1924 Fintel ..... A01K 1/0017 160/330
2,605,828 A * 8/1952 Lang ..... E06B 9/52 160/328
2,621,725 A * 12/1952 Shacikoski ..... E21F 1/10 454/170
2,863,164 A * 12/1958 Schesvold ..... A47H 15/04 16/87.4 R
3,000,016 A * 9/1961 Ridge ..... A47K 3/38 24/303
3,436,047 A * 4/1969 Foltz ..... A47H 1/104 248/317
3,464,480 A * 9/1969 Kuss ..... A47H 13/01 160/368.1
3,480,069 A * 11/1969 Handwerker ..... E04G 21/28 160/354
3,557,499 A * 1/1971 Dickie ..... E04B 2/827 52/36.4
3,591,940 A * 7/1971 Slemmons ..... G09F 15/02 40/603
3,608,266 A * 9/1971 Satkin et al. ..... E04B 2/7854 52/745.09
3,712,011 A * 1/1973 Husler ..... E04B 2/822 52/241
3,911,991 A * 10/1975 Malferrari ..... A47H 23/00 160/202
3,935,671 A * 2/1976 Soot ..... A01G 9/12 47/70
3,991,806 A * 11/1976 Abell ..... E06B 3/285 160/90
4,041,861 A * 8/1977 Alter ..... B41F 15/36 101/128.4
4,103,463 A * 8/1978 Dixon ..... E04B 2/824 52/126.4
4,133,367 A * 1/1979 Abell ..... E06B 3/28 160/354
4,193,235 A * 3/1980 Cucchiara ..... E06B 3/285 160/380
4,221,255 A * 9/1980 Barkemeyer ..... A47H 2/00 160/197
4,232,310 A * 11/1980 Wilson ..... B07B 1/4627 160/10
4,232,725 A * 11/1980 Gidge ..... E06B 3/80 160/332
4,277,920 A * 7/1981 Dixon ..... E04B 2/827 52/64
4,356,647 A * 11/1982 Farris ..... G09F 15/02 40/661
4,453,585 A * 6/1984 Ruggeberg, Sr. ..... F16B 5/0692 160/354
4,459,773 A * 7/1984 Sandlin ..... G09F 15/02 40/603
4,782,883 A * 11/1988 Braiotta ..... B44C 7/022 160/327
4,907,637 A * 3/1990 Hintsa ..... B44C 7/022 160/327
5,090,145 A * 2/1992 Chiang ..... A47G 1/065 40/605
5,116,056 A * 5/1992 Schmutte ..... A63B 63/00 160/330
5,217,057 A * 6/1993 Hubbard ..... A47H 5/00 160/123
5,226,468 A * 7/1993 Lord ..... A47H 13/00 160/399
5,237,786 A * 8/1993 Kochansky ..... E04B 2/821 52/126.4
5,381,991 A * 1/1995 Stocker ..... G09F 7/18 248/206.5
5,409,191 A * 4/1995 Wenmaekers ..... E04B 9/006 248/317
5,584,461 A * 12/1996 Pynenburg ..... G09F 15/0018 24/498
5,592,721 A * 1/1997 Zeller ..... B42F 15/066 24/115 L
5,911,266 A * 6/1999 Jacobs ..... A47H 13/00 160/330
6,173,753 B1 * 1/2001 Laster-Bivens ..... E06B 9/262 160/178.1 R
6,219,892 B1 * 4/2001 Johnsen ..... A47H 13/00 16/87.2
6,301,847 B1 * 10/2001 Beck ..... E04B 2/7425 52/239
6,314,687 B1 * 11/2001 Schondelmayer .... E04B 2/7425 160/351
6,502,357 B1 * 1/2003 Stuthman ..... E04B 2/7448 52/239
6,708,939 B2 * 3/2004 Walker ..... F16B 37/045 248/323
6,802,145 B2 * 10/2004 Sparkowski ..... G09F 7/18 40/606.18
6,802,357 B2 * 10/2004 Taylor ..... F16B 5/0028 160/371
6,813,863 B2 * 11/2004 Duffy ..... E04H 6/426 160/330
7,673,409 B2 * 3/2010 Pitcher ..... G09F 7/22 40/617
7,712,239 B2 * 5/2010 Pitcher ..... G09F 7/22 40/617
7,740,048 B2 * 6/2010 Wilson ..... E06B 9/52 160/371
7,743,541 B2 * 6/2010 Suciu ..... G09F 15/0018 40/658
7,823,311 B2 * 11/2010 Pitcher ..... G09F 7/10 40/790
7,832,454 B2 * 11/2010 Lyons ..... E04H 4/06 160/368.1
8,402,682 B2 * 3/2013 Boltz ..... G09F 17/00 40/604
8,403,021 B1 * 3/2013 Peterson ..... A47G 5/00 160/135
8,579,006 B2 * 11/2013 Levin ..... E04B 2/827 160/184
8,613,168 B2 * 12/2013 Von Hoyningen Huene ..... E04B 2/7407 52/125.1
8,684,067 B1 * 4/2014 Frame ..... H05K 7/1497 160/330
8,893,417 B2 * 11/2014 Miller ..... G09F 15/00 40/617
8,985,183 B2 * 3/2015 Terry ..... E06B 9/24 160/378
9,598,898 B2 * 3/2017 Colson ..... E06B 9/36
10,309,102 B2 * 6/2019 Von Hoyningen Huene ..... E04B 2/7455
10,867,530 B2 * 12/2020 White ..... B25J 1/04
10,920,926 B2 * 2/2021 Priola ..... G03B 21/56
2002/0000301 A1 * 1/2002 Rolin ..... E06B 9/52 160/330
2002/0011015 A1 * 1/2002 Larson ..... G09F 17/00 40/604
2004/0163295 A1 * 8/2004 Fontana ..... G09F 15/0018 40/617
2005/0034398 A1 * 2/2005 Mauk ..... E04B 2/7401 52/506.01
2007/0130853 A1 * 6/2007 Kennedy ..... A47H 23/04 52/238.1
2007/0209261 A1 * 9/2007 Stover ..... G09F 7/18 40/617
2007/0215297 A1 * 9/2007 Lin ..... A47H 1/04 160/332

(56) References Cited

U.S. PATENT DOCUMENTS

| | | | | |
|---|---|---|---|---|
| 2008/0000056 | A1* | 1/2008 | Murray | A47H 23/01 24/460 |
| 2009/0050280 | A1* | 2/2009 | Morris | A47H 23/04 160/345 |
| 2010/0218906 | A1* | 9/2010 | Marzilli | A47H 23/08 160/368.1 |
| 2011/0094162 | A1* | 4/2011 | Morris | A47H 23/04 49/409 |
| 2011/0203747 | A1* | 8/2011 | Chen | E04B 2/7448 160/210 |
| 2012/0018103 | A1* | 1/2012 | Ashelin | A47H 21/00 160/123 |
| 2013/0174991 | A1* | 7/2013 | Glikman | A47H 5/08 160/330 |
| 2014/0124148 | A1* | 5/2014 | Sickels | A47H 13/16 160/84.04 |
| 2019/0100959 | A1* | 4/2019 | Chang | A47H 23/01 |
| 2020/0024846 | A1* | 1/2020 | Von Hoyningen Huene | E04C 2/46 |
| 2020/0123767 | A1* | 4/2020 | Bibi | A47H 1/18 |
| 2020/0149346 | A1* | 5/2020 | Solomaniuck | A47H 23/01 |

* cited by examiner

METHOD AND SYSTEM FOR PROVIDING PREPARING AND ASSEMBLING A HIGH END PREFABRICATED PRODUCT TO SERVE AS A WINDOW COVERING OR ROOM DIVIDER

CROSS REFERENCES TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates generally to a method of manufacturing a particular covering, described herein, for an architectural opening and the hardware for use therein, wherein the covering includes a suspension rod (001), a locking pin (002), a rubber gasket (003) and a fabricated wood product (004) as a support structure, with a singular fabric mounted on the support structures (005), the movement of which is dependent upon the securing options desired by the user, as identified herein.

2. Description of the Relevant Art

While coverings for architectural openings have assumed numerous forms over a long period of time, during this process the window treatment industry has become increasingly standardized to address the demands of an increasing size of the population. The price of standardization generally is the users loss of personalization. Additionally, as the users interest and desires change over time, the complexities of window treatments, window coverings (to be used interchangeably throughout this application) continue to increase, and no longer can the user enjoy a simple installation, but rather, installation requires professional equipment such as heavy ladders, harnesses, heavy duty power tools, etc.

You can see this in the evolution of window coverings. Early forms of coverings included simple venetian blinds, in which a plurality of vertically extending cord or fabric ladders supported parallel horizontally extending slats in a manner such that the slats can be pivoted about their longitudinal axes between open and closed positions and the entire blind can be moved between an extended position wherein it extends across the practical architectural opening and a retracted position where the slats are accumulated in a vertical stack adjacent to the top of the architectural opening. This ultimately evolved into other things like retractable roller shades, curtains, draperies, and the like, each with their own unique mechanisms and systems, wherein the covering could be extended across any architectural opening or retracted to a top or side of the opening.

But as these evolved coverings began to enter the market, they each required unique tools and equipment that the average user simply did not have access too. This results in a substantial increase in costs for the user as more and more hands are involved in the installation process, each costing a fee.

Additionally, while the newer class of coverings were welcomed by the market, the user continues to evolve in their desire personalization. While coverings such as retractable roller shades, curtains, draperies, and roman shades, are certainly beautiful and aesthetically pleasing, because they are prefabricated and standardized, the user loses the ability to express their own aesthetically desires through their own personalization.

In recent times, based on our evolution in this industry, we are noticing that users are becoming more and more attracted to aesthetics and personalization. Users want their coverings, which are installed in their homes or offices, to reflect their own style and brand. Prefabricated window coverings do not offer this ability because the industry gives up personalization in exchange for standardization.

The recent emphasis on aesthetics and personalization in homes and building structures has maintained pressure on the industry to create uniquely aesthetically attractive coverings for architectural openings, which can be easily manipulated in design and build so as to reflect the desired personalization and brand of the user, which also have utilitarian functions such as unilateral installation, better insulation, better heat retention, and overall costs savings as a result. It is to respond to the demand of the market that the present invention has been made.

BRIEF SUMMARY OF THE INVENTION (MPEP 608.01(d)/SUMMARY OF THE INVENTION

The covering of the present invention includes a suspension rod (001), a locking pin (002), a rubber gasket (003), a fabricated wood support structure (004) which serves as a support structure from said suspension rod, held in place with a locking pin, which holds a singular piece of fabric material, extended across an architectural opening or retracted adjacent an edge of the opening, and a support system at the bottom of the product comprised of a second fabricated support structure, manipulating the desired placement of the user. The support structure is comprised of a first piece and a second piece on both the top and bottom, is manufactured out of wood and would be manufactured with a decorative finish.

The fabric material (005), which extends and runs vertically from top to bottom, can assume various forms and be of a variety of different materials, but wherein generally, a support structure supports a singularity of fabric (FIG. 2) in a manner such that the movement and flexibility of the fabric is dependent upon the type of fastening of the support structure at the bottom, as desired by the user (FIG. 3, FIG. 4). The support structure could be fastened using a set of truncated suspension rods (006), inverted suspension rods (007), or simply left to its own gravitational weight.

The fabric material (005), which is supported on the support structure (FIG. 2), can assume numerous forms including rigid, semi-rigid or flexible material of various configurations and relationships connected to the support structure at both the top and bottom of the vertical plane, to define and express the personalized aesthetic desires of the user. As more thoroughly explained below, the fabric material (005) is connected to the fabricated wood product supporting structures in a manner such that they are held into place using a rubber gasket at the top and bottom of the vertical plane (FIG. 2). The supporting structure at the bottom of the vertical plane is then held into place at the desired support of the user.

As will be appreciated with the detailed description that follows, each individual part of the fabric material can be interconnected with each other, connected individually to the support structure or they can be mounted on the support structure so that each individual part of the fabric material is not directly secured to the support structure, but rather the support structure is used to engage and lift the lowermost individual parts of the fabric material in the fabric when the covering is being retracted, thereby causing the individual parts of the fabric material to accumulate and stack on the top of the most lower individual piece of the fabric material.

Other aspects, features and details of the present invention can be more completely understood by reference to the following detailed description of preferred embodiments, taken in conjunction with the drawings and from the appended claims.

BRIEF DESCRIPTION OF THE SEVERAL VIEWS OF THE DRAWINGS

Further.

FIG. 2A is a fragmentary isometric showing a front view of the placement of the small magnetized discs (009), relative to the length of fabricated wood product (004) as well as to the placement of the suspension rods (001).

DETAILED DESCRIPTION OF THE INVENTION

Figures 1, 1A:
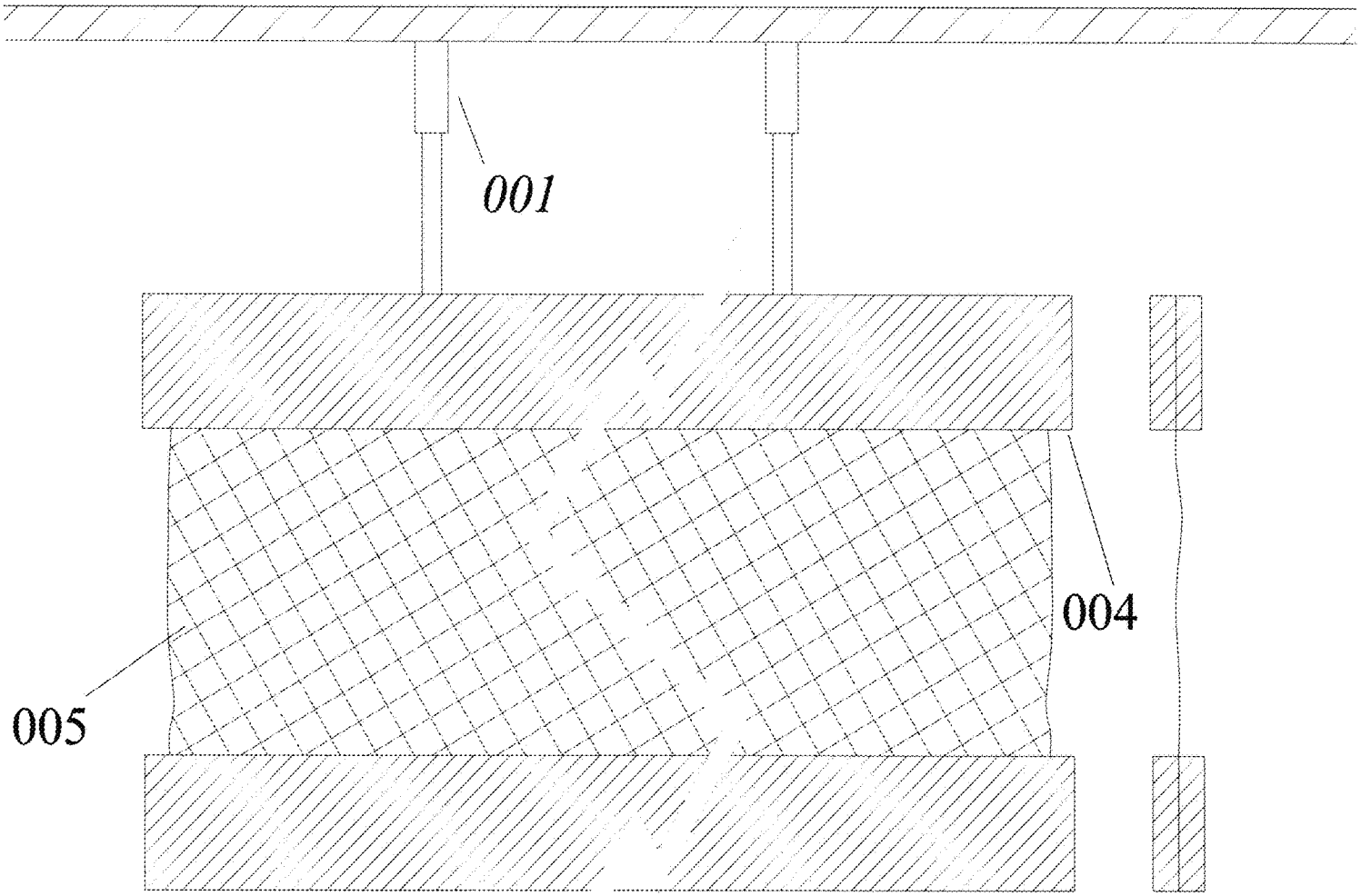
FIG. 1 is a front view of a fully assembled covering entirely extended, displaying the suspension rods (001), the fabricated wood product at the top of the vertical plane serving as a support structure, comprised of a top first piece and a top second piece (004), which holds in place the fabric running down the vertical plan (005), connected to a second fabricated wood product serving as a second support structure comprised of a bottom first piece and a bottom second piece also manufactured from wood (008), in which the user has opted to use the support structures own gravitational weight as their desired fastening system at the bottom for a long lasting hold.
FIG. 1A is a side isometric view of the fully assembled covering entirely extended presented in FIG. 1.

The decorative finished wood system (present invention) includes a method of manufacturing a particular covering for an architectural opening which is designed to be fully manipulated by the user. The system is one that offers the user a tremendous amount of flexibility and variety as to the materials used, as well as the aesthetic features of the product, however it is predicated off a consistent and certain underlying structure.

The system includes a specific configuration of suspension rods (001), a locking pin (002), rubber gaskets (003), fabricated wood products (004) which serve as a support structure for a unit of fabric material (005), which is then to be extended across an architectural opening or retracted adjacent an edge of the opening, and supported by a support system at the bottom of the product comprised of a second fabricated support structure (008), manipulating the desired placement of the user.

As will be appreciated from the detailed descriptions that follow, the fabric material (005) can be in the form of flexible, rigid, or semi-rigid of material, which are either singular or multiple, connected to the support structure, both top and bottom, at spaced locations across the horizontal plane, traversing through a vertical plane.

As used in this Specification, the term "material" refers to its text book definition of "the matter of which a thing is or can be made." One skilled in the art and familiar with the industry practice understands that fabric material can be made of either (a) soft and flexible materials such as vinyl, woven or non-woven fabric, cords of natural or synthetic fibers, monofilaments, and the like; (b) rigid materials such as resin reinforced fabrics, polyethylene, wood, aluminum or other metals; and (c) semi-rigid materials such as flexed or folded materials made from resin reinforced fabric, polyvinyl chloride, and the like.

The user begins by installing the suspension rods (001) into the architectural opening. Depending on the desired size of the end product, and its length across the horizontal plane, the user would need to install multiple suspension rods (001), as spaced locations. While the present invention, through its drawings, display only two suspensions rods (001), the user will have the ability to use as many as desired, depending on the size of the fabricated wood product desired (004).

The fabricated wood product (004) consists of a first face (010) and a second face (011). The first face (010) and second face (011), when used in conjunction with one another, serve as the fabricated wood product which will hold a piece, or multiple pieces, of fabric material (005), which traverses in a vertical plane, and connected to a second fabricated support structure (008), at the bottom end of the present invention, which can be fastened in place using a variety of methods, as discussed herein.

Figure 2:
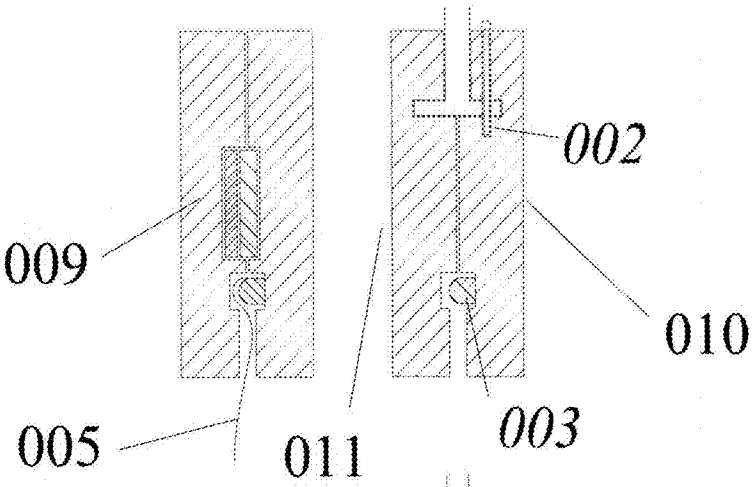
FIG. 2 is a fragmentary isometric showing the how the suspension rod (001) is placed in between two fabricated wood products, defining a first face (010) and a second face (011), combined to make a support structure, and further held in place with a locking pin (002), in order to secure the support structure to the suspension rod (001).

As shown in FIG. 2, the suspension rod (001) is placed in between two pieces of fabricated wood product (004), the first face (010) and the second face (011). The first face is placed, being further held by a locking pin (002). This enables the user to position it freely, without assistance from others, encouraging an easier installation. Once the first face (010) is held into place with the locking pin (002), the user than can proceed to inset one side of a magnet (009) on to the first face (010).

Figure 2A:
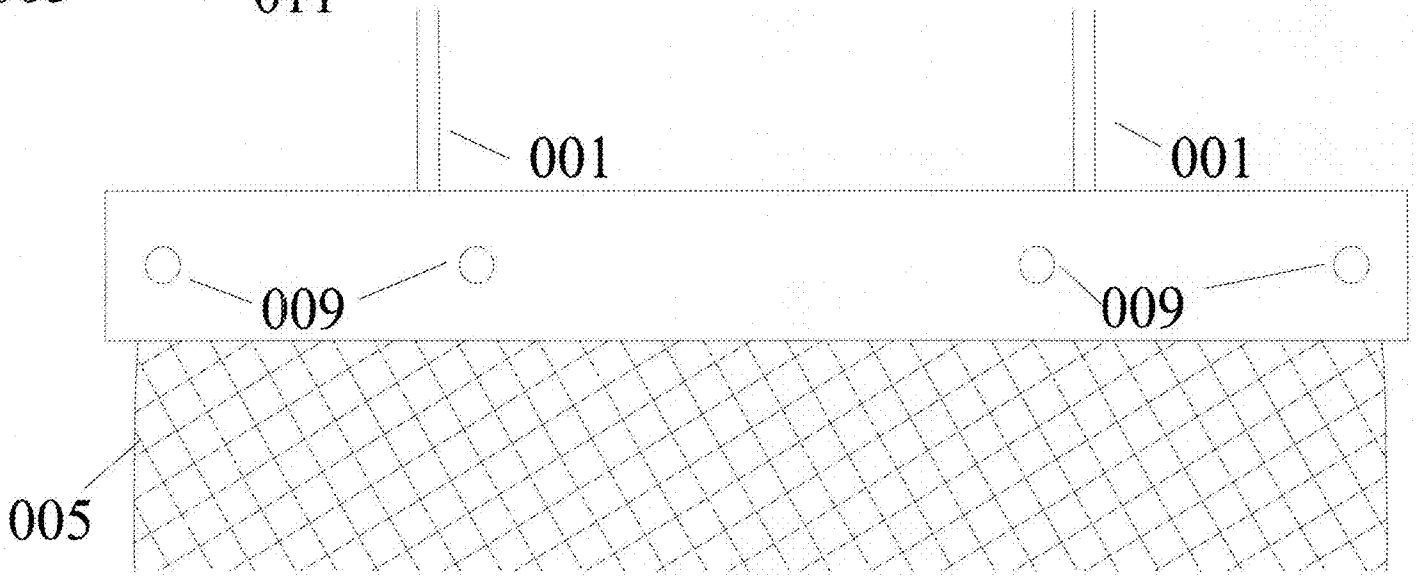
FIG. 2A shows how the fabricated wood product (005) is connected, consisting of a first face (010) and a second face (011), using small magnetized disc (009). When the first face (010) and a second face (011) are connected, they then serve as the support structure for the fabric material (005) hanging below. You can see how the support structure, consisting of a first face (010) and a second face (011) the lock in the fabric material (005) by double sided tape, as well as the rubber gasket (003), which results in substantial pressure holding the fabric material in place.

As shown in FIG. 2A, the user has flexibility as to the amount and location of the small magnetized discs (009) on the fabricated wood product (004). While the present drawings embody a system which uses four small magnetized discs (009), at specified locations, the user certainly can place them wherever they believe it would be best, as well as the amount of small magnetized discs used, to their required strength.

At that point, the user than can assemble the fabric material (005) and connect it to the first face (010) of the fabricated wood product (004). You will see in FIG. 2 that the fabric material (005) is held into place using a rubber gasket (003) and double-sided tape. The combination of the rubber gasket (003) and double-sided tape has been shown to create the optimal amount of pressure to encourage permanency for the user. Once the fabric material (005) is held into place and connected to the first face (010) of the fabricated wood product (004), the user can then install the second face (011) by fastening the two fabricated wood products (004) together using the small magnetized discs (009) placed on both the first face (010) and the second face (011).

Once the first face (010) and second face (011) have been connected by the small magnetized discs (009), collectively known as the fabricated wood product, the user will then have the top portion of the present invention completed. Note that the fabricated wood product (004) at the top location, once completed, will then hold the fabric in a permanent fashion, which will extend on to the users desired length, through the vertical plane. The fabric material will then hang, serving as the majority of the covering for the architectural opening.

Once the top of the present invention is prepared, the user will then need to determine how they will secure and fasten the fabric material, to ensure the placement as desired by the user, to cover the architectural opening. The present invention provides the user with three (3) specific options on how they wish to support the present invention on the bottom. Depending on the intention of the user, there are varying placements that the user can choose from, which will determine the overall strength of the supporting structure.

The drawing in FIG. 1 is an embodiment of the present invention, in the instance where the user desires to simply permit the weight of the present invention to remain free standing and hold it in place using its own gravitational weight for a long lasting hold. In an this instance the fabricated support structure at the bottom is simply left free standing by the user, where the substantial weight holds it in place using gravitational pressure.

In this instance, the user would simply have to repeat the steps as identified above to achieve the desired gravitational condition. The user would take the bottom end of the fabric material (005) and connect to a second fabricated wood product (004) which serves as a support structure at the bottom of the present invention (008). This support structure (008) is the same fabricated wood product (004) as the fabricated wood product (004) connected at the top of the present invention, and similarly to the fabricated wood product at the top, it is comprised of a first face (010) and second face (011). The bottom of the fabric material (005) is held into place using an additional rubber gasket (003). Once the fabric material (005) is held into place and connected to the first face (010) of the fabricated wood product (004), the user can then install the second face (011) by fastening the two fabricated wood products (004) together using the small magnetized discs (009) placed on both the first face (010) and the second face (011). Collectively, this constitutes the support structure at the bottom (008).

Assuming a heavier weighed fabric material (005) and fabricated wood product (004), the bottom support structure (008) will achieve a long term hold just using its own gravitational pull.

There are two other options for a secure hold for the user.

Figure 4:
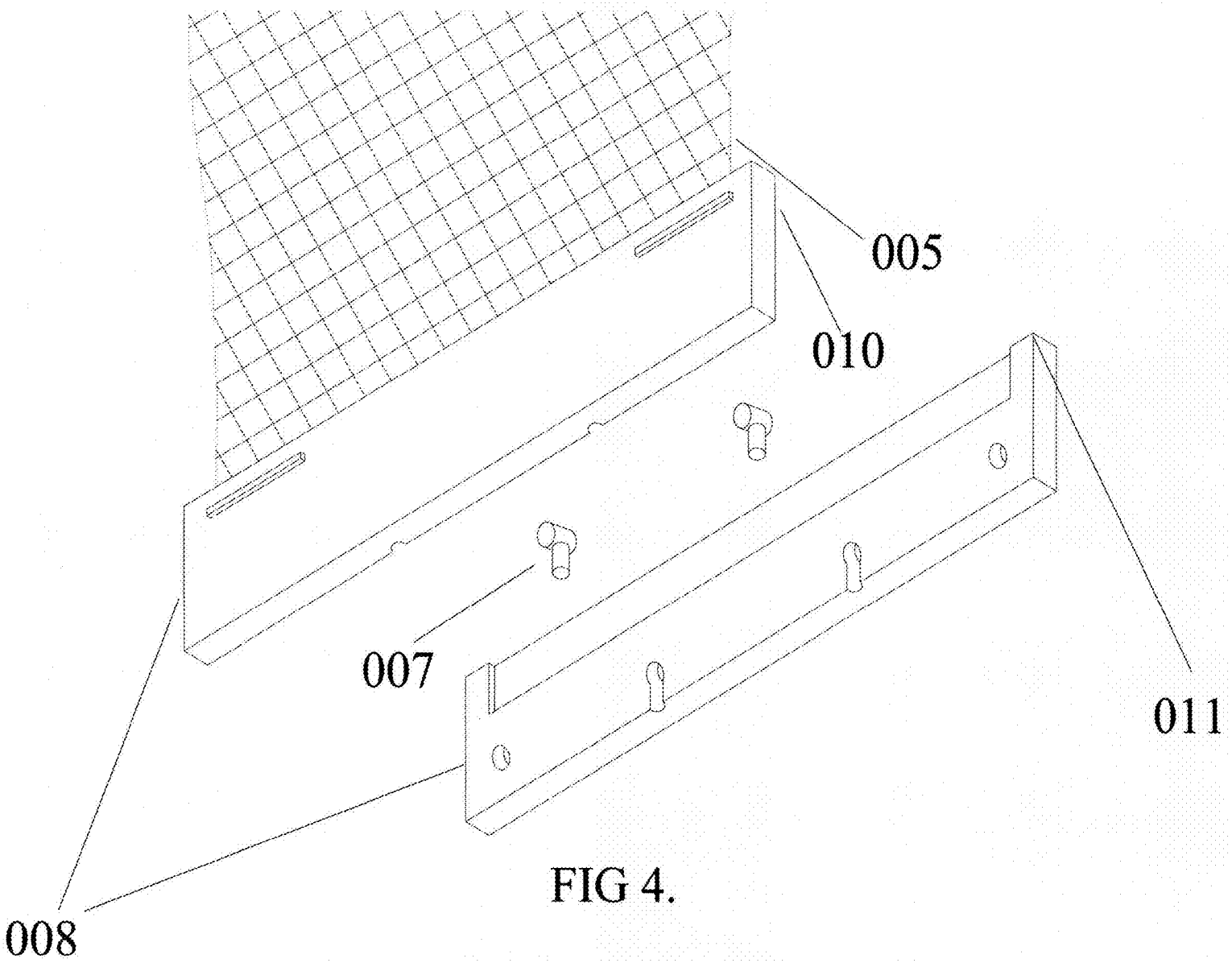
FIG. 4 is a fragmentary isometric serving as an embodiment of how the fabricated wood product serving as a support structure on the bottom of the vertical plane is fastened and secured in placing using a system of inverted suspension rods (007), in accordance with the present invention, in a fully extended position.

FIG. 4 is the embodiment of how the fabricated wood product on the bottom of the present invention is fastened and secured in placing using a system of inverted suspension rods (007). The inverted suspension rods (007) are simply suspension rods (002) placed in a vertically inverted fashion. They are not modified as to their length, and they are utilized in their natural state. This version will create a secure connection and as a result of the fabric material being in a fully extended position, this will securely obstruct the architectural opening. All other instructions on how to fasten the fabric material (005) apply in this instance as well.

Figure 3:
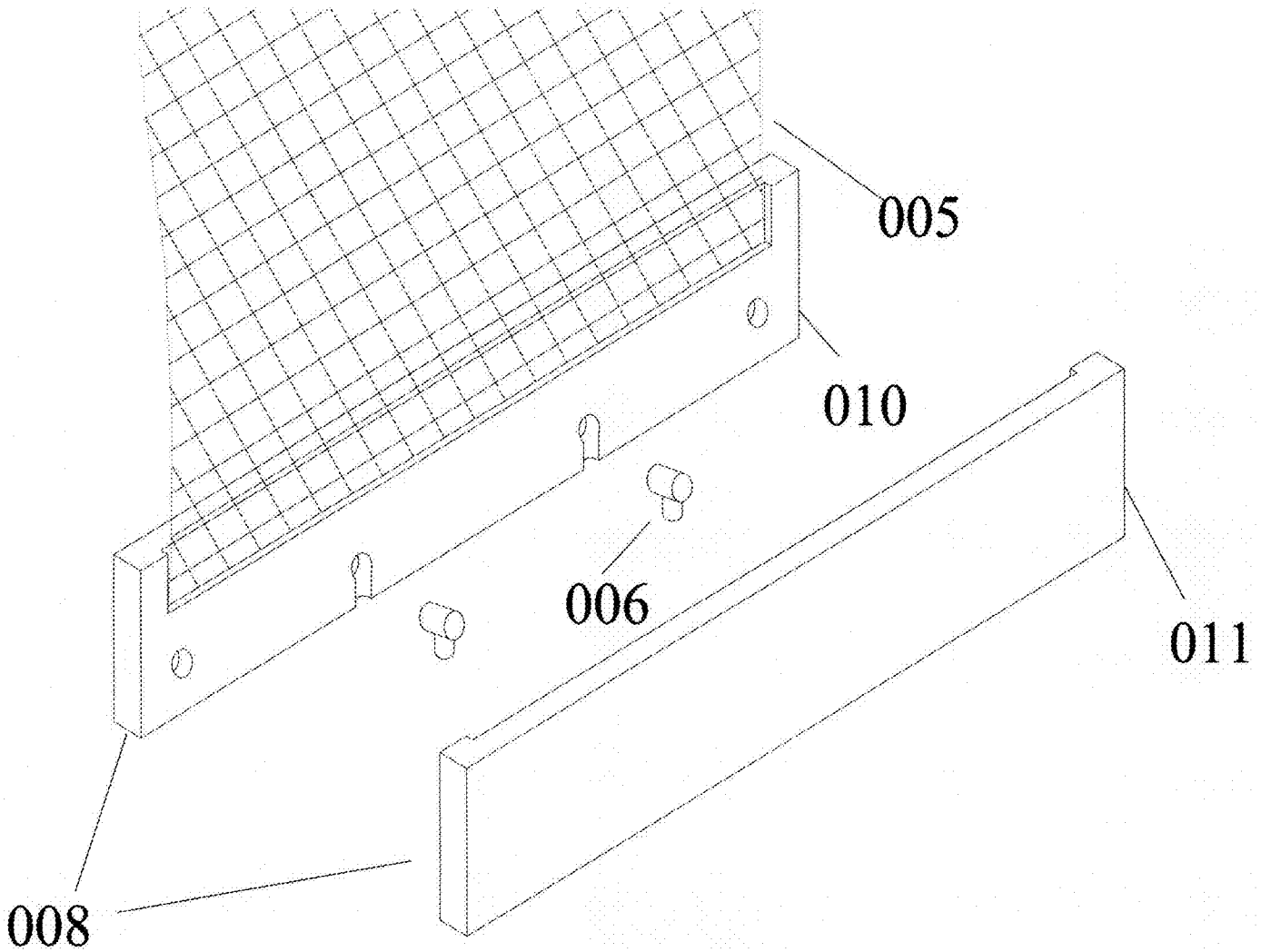
FIG. 3 is a fragmentary isometric serving as an embodiment of how the fabricated wood product (004), by using a first face (010) and a second face (011), when used in conjunction, serve as a support structure on the bottom of the vertical plane (008). This embodiment shows how the support structure at the bottom of the vertical plane (008) is fastened and secured in placing using a system of truncated suspension rods (006), in accordance with the present invention, in a fully extended position.

FIG. 3 is the embodiment of how the fabricated product on the bottom of the present invention is fastened and secured in placing using a system of truncated suspension rods (006). The truncated suspension rods (006) are also suspension rods (002) placed in a vertically inverted fashion, but in this method, the user reduced their size, or makes some other physical alteration, which in effect would reduce the open space between the bottom support structure, and the floor of the architectural opening. This option may be desired by the user for a variety of reasons, including but not limited to, aesthetics, reduced light seepage, reduced acoustical seepage, increased opaqueness, increased privacy, to name a few.

This version will create a secure connection and as a result of the fabric material being in a fully extended position, this will securely obstruct the architectural opening, as modified by the users desired open space at the bottom. All other instructions on how to fasten the fabric material (005) apply in this instance as well.

The method of manufacturing a covering for an architectural opening, as well as the covering itself, being proposed in the present invention was borne out of necessary in the industry, being a unique product, first of its kind. It provides the user with substantial advantages in (i) simplicity of installation, enabling an unilateral and cost effective installation, (ii) providing a near flawless visual presentation, as all the connectors are hidden or out of sight when the product is finished, and (iii) total customization and personalization for the user, and the system is comprised of multiple small parts, each enabling the user to modify as they deem fit.

It will be appreciated from the above, that a covering for an architectural opening has been described that could include many different variations as it concerns the particular fabric material, as well as the material used for the fabricated product. As more thoroughly discussed herein, it is evident from the above that the fabric material, as well as the fabricated product, could take numerous configurations or sizes and the support structure could also be varied as well as the system employed for extending and retracting the fabric material. It will also be appreciated that hybrid fabrics can be used for varied aesthetics and further the fabric can be cut to any desirable shape to accommodate any configuration of an architectural opening. The fabric material can be disposed of by a bottom-up operation, top-down operation, or both top-down and bottom-up operations.

Accordingly, while the intention of this application was designed to protect and discuss both the coverage for the architectural opening, as well as the method of manufacturing such coverage, the fact is that this invention is extremely versatile and while illustrative embodiments have been disclosed, it will be apparent to those skilled in the art that many variations and combinations of embodiments and arrangements disclosed herein could be employed.

Although the present invention has been described with a certain degree of particularity, it is understood the disclosure has been made by way of example, and changes in certain details or structures may be made without departing from the spirit of the invention, as defined, in the appended claims.

Invention claimed is as followed:

1. A covering for an architectural opening, comprising:

a suspension rod, a locking pin, a rubber gasket, a support structure, said support structure secured to and suspending from said suspension rod with said locking pin passing through said suspension rod and support member, said support structure having a top first piece and a second piece opposite said top first piece, said top first piece and top second piece held together with magnets, a singular piece of fabric fastened between said top first piece and top second piece of said support structure via said rubber gasket, said rubber gasket and fabric secured between said top first piece and top second piece and held together by said magnets, said fabric extending horizontally across said support structure, and further extending downward from said support structure along a vertical plane, and a bottom support structure secured at the bottom of the vertical plane, said support structure having a bottom first piece and a bottom second piece, said fabric fastened between said bottom first piece and bottom second piece.

2. The covering of claim 1, wherein said supporting structure at both the top of the vertical plane and bottom of the vertical plane are comprised of wood.

3. The covering of claim 1, wherein said single piece of fabric may be comprised of cotton, linen, polyester, wool, velvet, lace, silk canvas, denim, or suede.

4. A method of manufacturing a covering for an architectural opening, comprising:

a support structure which is connected to the ceiling of an architectural opening by attached suspensions rods to the ceiling of said architectural opening, and connecting them between two pieces of a fabricated support structure, a top first piece and a second first piece, further held in place with a series of magnets and a locking pin;

a singular piece of fabric is then fastened to the top support structure by first holding it in place using double sided tape, then inserting a rubber gasket to create a permanent hold, with said fabric traversing the vertical plane;

and said singular piece of fabric is then fastened to the bottom support structure by first holding it in place using double sided tape, then inserting a rubber gasket to create a permanent hold.

5. The method of claim 4, wherein said supporting structure at the bottom of the vertical plane is secured in place, or made permanent, by attaching a set of inverted suspension rods.

6. The method of claim 4, wherein said supporting structure at the bottom of the vertical plane is secured in place, or made permanent, by attaching a set of truncated suspension rods.

7. The method of claim 4, wherein said supporting structure at the bottom of the vertical plane is secured in place if left free standing, with the fabric in a full extended condition, using its own gravitational weight for support.

* * * * *